US008100248B2

(12) United States Patent
Graf et al.

(10) Patent No.: US 8,100,248 B2
(45) Date of Patent: Jan. 24, 2012

(54) DEVICE FOR SORTING COINS, TOKENS, CHIPS AND THE LIKE

(75) Inventors: Johann F. Graf, Gumpoldskirchen (AT); Marek Gawel, Traiskirchen (AT)

(73) Assignee: Novomatic AG, Gumpoldskirchen (AT)

( * ) Notice: Subject to any disclaimer, the term of this patent is extended or adjusted under 35 U.S.C. 154(b) by 0 days.

(21) Appl. No.: 12/227,369

(22) PCT Filed: May 15, 2007

(86) PCT No.: PCT/EP2007/004311

§ 371 (c)(1),
(2), (4) Date: Nov. 14, 2008

(87) PCT Pub. No.: WO2007/131772

PCT Pub. Date: Nov. 22, 2007

(65) Prior Publication Data

US 2009/0139829 A1 Jun. 4, 2009

(30) Foreign Application Priority Data

May 17, 2006 (DE) ..... 20 2006 007 923

(51) Int. Cl.
*G07F 1/04* (2006.01)

(52) U.S. Cl. ..... 194/344; 193/DIG. 1

(58) Field of Classification Search ..... 194/344, 194/346; 193/DIG. 1, 14, 31 A; 453/18–28, 453/63; 446/8; 463/46
See application file for complete search history.

(56) References Cited

U.S. PATENT DOCUMENTS

| | | | | | |
|---|---|---|---|---|---|
| 3,481,443 | A | * | 12/1969 | Meloni | 194/317 |
| 3,916,922 | A | * | 11/1975 | Prumm | 453/3 |
| 5,040,658 | A | * | 8/1991 | Levasseur | 194/346 |
| 5,131,518 | A | | 7/1992 | Shimizu | |
| 5,346,047 | A | * | 9/1994 | Ishida et al. | 194/200 |
| 5,490,588 | A | * | 2/1996 | Nishiumi et al. | 194/317 |
| 5,496,212 | A | * | 3/1996 | Meyer-Weingartner et al. | 453/4 |
| 5,676,234 | A | | 10/1997 | Smith et al. | |
| 5,769,200 | A | * | 6/1998 | Meyer et al. | 194/203 |
| 5,875,879 | A | * | 3/1999 | Hawthorn | 194/350 |
| 7,341,508 | B2 | * | 3/2008 | Rigo | 453/18 |

FOREIGN PATENT DOCUMENTS

| | | |
|---|---|---|
| DE | 3718979 | 12/1988 |
| DE | 9306231 | 7/1993 |
| EP | 0622763 | 11/1994 |
| EP | 0762345 | 3/1997 |

* cited by examiner

*Primary Examiner* — Mark Beauchaine
(74) *Attorney, Agent, or Firm* — Dilworth & Barrese, LLP.

(57) ABSTRACT

An apparatus is provided for sorting coins and the like having a chute which has at least one inlet and a plurality of outlets. The chute has at least two flat side outlets which are arranged one above the other in the falling direction through the chute with a respective shunt being associated with the flat side outlets. The chute advantageously has two oppositely disposed wide flat sides and two oppositely disposed narrow sides. The wide flat sides are disposed opposite the wide flat sides of a coin. The coins are accordingly channeled away transversely to their flat sides via the flat side outlets. The plurality of flat side outlets arranged above one another have the great advantage in this respect that the coin sorting body can be made in particularly compact form. In addition, the small required switch paths permit very short switch times of the shunts.

26 Claims, 2 Drawing Sheets

DEVICE FOR SORTING COINS, TOKENS, CHIPS AND THE LIKE

BACKGROUND OF THE INVENTION

The present invention relates to a device for sorting coins, tokens, chips and the like comprising a chute which has at least one inlet and a plurality of outlets and which possesses a flat, substantially rectangular cross-section, wherein a movable shunt is associated with at least one of the outlets, said shunt being movable between a channeling away position engaging into the chute and a passage position.

In various devices actuable by money or money-like objects such as gaming machines and/or entertainment devices, coin sorters are used as a rule to separate coins, chips or tokens inserted into the respective machine and/or device into different storage containers or further processing modules. In a gaming machine actuable by money, for example, some of the inserted coins thus have to be conveyed into a pay-out store from where the winnings are paid out, whereas some other inserted coins have to be conveyed into the cash store of the machine. Provision can be made in gaming machines actuable by coins and tokens to convey the tokens into a token store and the coins into a coin store by a corresponding coin sorter.

Such coin sorters are as a rule positioned after a coin checker which first checks the authenticity or value of the coins. A chute of the coin sorter adjoins an outlet of the coin checker, said chute having a sufficient inclination such that the coins to be sorted can fall or slide through the chute. The chute has a plurality of outlets of which at least one is provided with a shunt so that the coins falling through the chute can be channeled away via different outlets depending on the shunt position.

A coin sorter is proposed in U.S. Pat. No. 5,915,520 wherein two flaps are arranged in a chute oriented substantially vertically and are connected to one another via a spring, with the upper of the two flaps being able to be deflected against the spring with sufficiently heavy coins, while the lower of the two flaps can be actuated via a magnetic actuator. In this already known coin sorter, however, only counterfeit coins can be sorted out from genuine coins, while a further division of the genuine coins, for example into a pay-out store, on the one hand, and into a cash store, on the other hand, is no longer possible. On the other hand, a lot of height is lost until the coins reach the chute outlet due to the arrangement of the two flaps above one another. This is in particular of importance with gaming machines or entertainment devices in which some of the coins should be guided onto a pay-out store in the interior of the machine or device. To enable a modular construction and an ergonomically favorable operation, the coin insertion slot and the coin processing and pay-out unit are combined in one middle machine section here. To be able to work without complex and/or expensive coin conveying devices here, the available falling or sliding height must be used sparingly.

SUMMARY OF THE INVENTION

It is therefore the underlying object of the present invention to provide an improved device for sorting coins, tokens, chips and the like which avoids the disadvantages of the prior art and further develops the latter in an advantageous manner. A sorting apparatus should preferably be provided which has a compact size, only takes up a small construction height, has a high sorting speed and permits high throughputs without impairing the sorting reliability.

This object is solved in accordance with the invention by a device described herein. Preferred embodiments of the invention are also the subject herein.

It is therefore proposed to provide the chute with at least three or also more outlets and to arrange them in a special manner in order to achieve a compact construction without any larger height losses despite the increased number of outlets. In accordance with the invention, the chute has at least two flat side outlets which are arranged above one another in the falling direction through the chute and which branch off the chute at a flat side of the chute and which also have a base outlet which substantially branches off the chute in the falling direction, with a respective shunt being associated with the flat side outlets. The flat side of the chute in this respect means the chute side which is disposed opposite one of the two flat sides of the coins falling through the chute. The chute advantageously has a pressed flat cross-section which is preferably essentially rectangular, has two oppositely disposed wide flat sides and two oppositely disposed narrow sides and forces the coins falling or sliding through the chute into a predetermined direction. The flat sides are in this respect not disposed opposite the cylindrical jacket surfaces of the coins and/or tokens or chips, but opposite the flat sides showing the coin embossing such as value numbers or heads. The coins are accordingly channeled away transversely to their flat sides via the flat side outlets. The plurality of flat side outlets arranged above on another have the great advantage in this respect that the coin sorting body can be made in particularly compact form since the flat side outlets can be arranged very closely above one another independently of the coin diameter and the shunts associated with the flat side outlets also only require a very limited switch path which can be a great deal smaller than it could be if the coins were channeled off via their jacket surface sides. In addition, the small required switch paths permit very short switch times for the shunts, whereby a high throughput can be achieved.

The flat side outlets of the chute can generally be arranged in varying manner. To provide a particularly compact arrangement which works reliably, in a further development of the invention, the two flat side outlets can each have an outlet channel which is inclined at an acute angle to the falling direction of the chute and via which the respective coins or tokens can be channeled off. The outlet channel can be defined in this respect by an outer wall and by the shunt in its channeling off position which can extend approximately parallel to one another in the channeling off position of the shunt. All the flat side outlets advantageously have substantially the same inclination in this respect. The acute inclination angle can generally be selected to be different, with it advantageously amounting to less than 45° to the falling direction of the chute. In accordance with an advantageous embodiment of the invention, the flat side outlets can branch off the chute at an angle to the falling direction of the chute of approximately 20° to 40°.

It is generally conceivable to distribute the flat side outlets over the two oppositely disposed flat sides of the chute. In a further development of the invention, however, the flat side outlets are arranged on the same flat side of the chute.

An embodiment with a particularly small construction can be achieved in that the chute is arranged sandwiched between the flat side outlets, on the one hand, and a control device and/or actuation device for the shunts of the flat side outlets. In accordance with an advantageous embodiment of the invention, a printed circuit board having control components for the control of the shunts is arranged on the flat side of the chute disposed opposite the flat side outlets.

In a further development of the invention, the chute has a substantially perpendicular falling direction. Generally, however, a perpendicular arrangement of the chute is not compulsory; the chute only has to be inclined sufficiently pronouncedly to allow the coins, tokens or chips to fall or slide through the chute driven by gravity. A substantially perpendicular orientation is, however, preferred since this brings along advantages with respect to high throughput rates.

In a further development of the invention, the passage of coins, tokens and/or chips through the coin sorter, in particular its chute, is monitored to be able to detect sorting errors or to be able to immediately recognize operational malfunctions. In a further development of the invention, respective passage monitoring means, which can generally have different designs, are associated both with the inlet of the chute and the two flat side outlets and the base outlet. The passage monitoring means can operate, for example, optically, mechanically, but also electrically. The signals of the passage monitoring means can be further processed in different ways. In accordance with an advantageous embodiment of the invention, a connection of the passage monitoring means can be provided to a counter and/or to a counter memory so that coins and/or tokens or chips channeled off via the respective outlets can be counted and the count can be stored. Alternatively or additionally, a connection of the passage monitoring means can be provided to an error alarm which outputs an error message in the event of errors, for example when a coin input, but no associated coin output is detected.

In accordance with an advantageous embodiment of the invention, a respective light barrier is associated with the inlet of the chute and the base outlet of the chute for the monitoring of the passage of a coin, of a chip or of a token. Alternatively or additionally to such light barriers, the passage monitoring means associated with the flat side outlets can each have position detectors, for example in the form of electrical contacts, by means of which the shunt position of the shunts associated with the flat side outlets can be monitored. If a shunt position detector determines that the respective shunt has fully reached the channeling off position, it can be assumed that the corresponding coin is channeled into the respective outlet via the shunt.

To achieve high sorting speeds, the shunts associated with the flat side outlets are, in an advantageous further development of the invention, actuable independently of one another, with preferably a separate actuator operable with outside energy being associated with each shunt for the actuation of the respective shunt. The actuators can have different operating principles in this respect. In accordance with an advantageous embodiment of the invention, electromagnetic actuators can be provided for the actuation of the shunts. They permit a precise and simple control and reach high switch speeds.

To achieve a direct response of the shunts, they are advantageously not connected to the actuators via fairly long deflection chains with corresponding transmission elements, but are rather coupled as directly as possible to the actuators. In accordance with an advantageous embodiment of the invention, the actuators are substantially seated at the level of and directly opposite the shunts actuating them, with an overall compact arrangement being able to be achieved when the actuators are positioned on the flat side of the chute disposed opposite the flat side outlets. The actuators are preferably coupled directly via only one tie rod and/or one pressure transfer member to the respective shunt. In accordance with an advantageous embodiment of the invention, a shift fork can be pivotally connected to the respective shunt, said shift fork being coupled to the setting member of the actuator.

The shunts themselves can generally be of different design and/or have different bearings. In a further development of the invention, pivotably supported rockers are provided which can be pivoted into the chute around a pivot axis transversely to the falling direction to be able to channel off the coins falling through there.

An electronic control device for the control of the shunts is advantageously provided which preferably controls the shunts in dependence on a signal of a predisposed coin checker. Different coins can hereby be channeled off via different outlets of the chute; for example, tokens can be guided via the first flat side outlet and coins via the second flat side outlet to respective payout stores. Provision can alternatively be made that smaller coins, for example with a value of up to 50 euro cents, are channeled off via a first flat side outlet, while larger coins with a value from €1 and above are channeled off via the second flat side outlet to be guided to corresponding payout stores. Provision can optionally also be made that only coins of the same value are channeled off through a respective outlet. This is, however, by no means compulsory, i.e. coins of different values can also be channeled off via the same outlet. Further sorting criteria for the control of the shunts are naturally possible.

To be able to reach high throughput rates through the coin sorter without impairing the sorting reliability, provision can be made in a further development of the invention that the electronic control device is connected to the passage monitoring means associated with the inlet of the chute and controls the respective shunt in dependence of a signal of this passage monitoring means. In particular on the presence of a light barrier at the inlet of the chute, the control device can actuate the respective shunt into its channeling off position when the light barrier reports the falling through of a coin and a report is given by the coin checker that the respective coin is to be channeled off at the respective outlet. The control of the shunts can be carried out by the control of the shunts in dependence on a passage signal at the inlet of the chute in real time without any larger tolerances as a result of different fall-through speeds.

The shunts are advantageously reset after each channeling off of a coin so that the coin sorter is in a defined starting position after each channeling off of a coin. This makes it possible, for example, to effect a passage inspection by simple position detectors of the named kind which monitor the position of the shunts. In a further development of the invention, the electronic control device can have a timer by means of which the shunts are only actuated into their channeling off position within a predetermined time window after output of the signal of the passage monitoring means at the chute inlet. The restoration takes place in each case at the end of the predetermined time window, with switch times being able to be provided here in the range of milliseconds so that a plurality of switch procedures can be provided per second and thus a correspondingly high coin throughput.

In a further development of the invention, the shunts can be actuated with a compulsory control in both opposite directions of movement, i.e. both in the channeling off position and in the pass position. For this purpose, the shunts can be moved by dual-action actuators which can effect a compulsory movement both in the channeling off position and in the pass position.

Even if the coin sorter can generally be used in different applications, particular advantages result on use of the coin sorter in a gaming machine and/or entertainment device actuable by money and/or money-like objects. The flat side outlets of the chute are preferably arranged such that they lead into the interior of the machine body of the respective gaming machine and/or entertainment device, i.e. they are arranged on the side remote from a respective housing wall, for example a front side of the machine housing, and lead directly into the interior of the gaming machine and/or entertainment device, in particular onto the hoppers which are provided there and from which winnings of the gaming machine and/or entertainment device are paid out. The advantage of the compact arrangement of the sorting device, which only takes up a small falling distance, is of particular effect in this respect.

BRIEF DESCRIPTION OF THE DRAWINGS

The present invention will be explained in more detail in the following with reference to a preferred embodiment and to associated drawings. There are shown in the drawings.

DESCRIPTION OF THE PREFERRED EMBODIMENTS

Figure 1:
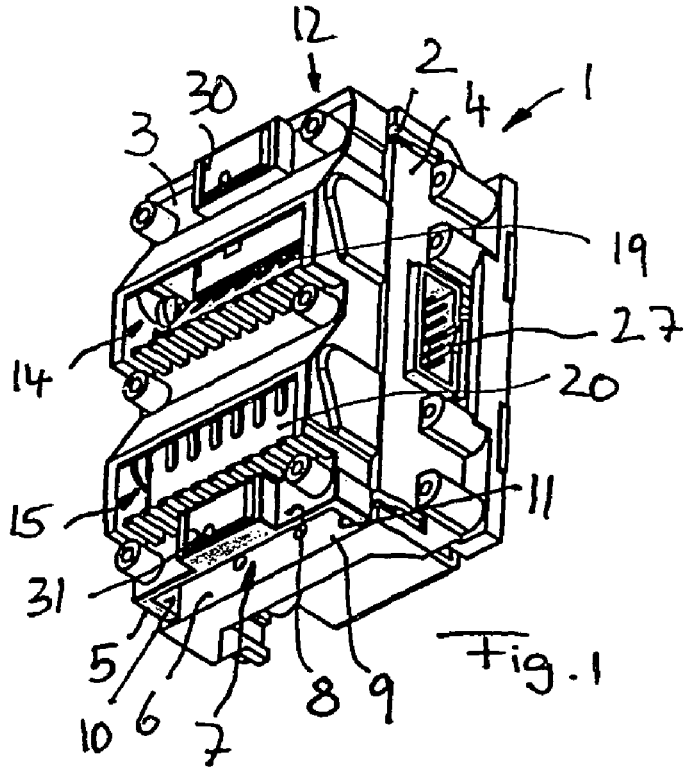
FIG. 1: a perspective schematic representation of a sorter with two flat side outlets in accordance with an advantageous embodiment of the invention.

The sorting device 1 drawn in the Figures includes a—simply stated—approximately cuboid sorting body 2 which is made in multiple parts in the embodiment drawn and includes two housing parts 3 and 4 which are set above one another and which can be injection molded from plastic.

The named housing parts can include a molded chute part 3 as well as a control housing part 4 which can be set above one another. The molded chute part 3 has a substantially trough-shaped contour with a U-shaped cross-section. The side bounding webs 5 are seated on a back 6 of the control housing part 4 which is substantially planar so that a chute 7 with a pressed flat cross-section is defined between the two housing parts 3 and 4, said chute passing through the total length of the device body 2 and having a substantially straight extent.

The chute 7 has a flat, substantially rectangular cross-section, with the two flat sides 8 and 9 being formed by the flat center portion of the molded shaft part 3 and the back 6 of the control housing part 4, while the narrow sides 10 and 11 of the chute 7 are formed by the side bounding webs 5 of the molded chute part 3. The cross-section is dimensioned in this respect such that coins falling through the chute 7 adopt a specific orientation, namely such that the flat sides of the coin bearing the embossing are disposed opposite the flat sides 8 and 9 of the chute 7, i.e. the spacing of the flat sides 8 and 9 is smaller in the drawn embodiment than the diameter of the smallest coin to be sorted. In the embodiment drawn, the chute 7 is pressed flat such that its one main axis is more than twice as long as its second main axis perpendicular thereto. The spacing of the narrow sides 10 and 11 from one another can amount to more than twice, preferably more than three times the spacing of the flat sides 8 and 9 from one another.

The sorting body 2 is oriented in accordance with its purpose such that the chute 7 extends substantially perpendicular. The chute 7 is open at its two ends so that the upper end of the chute 7 forms the inlet 12 of the chute 7, while the lower open end of the chute 7 forms its base outlet 13.

The chute in the embodiment drawn has two further outlets between the inlet 12 and the base outlet 13 of the chute 7 which are arranged on the flat side 8 of the chute 7 formed by the molded chute part 3 and thus form flat side outlets 14 and 15 which branch off at the sides of the chute 7 which faces the flat sides of the coins falling through the chute 7.

The flat side outlets 14 and 15 are arranged over one another in the falling direction through the chute 7, with the lower flat side outlet 15 being arranged above the base outlet 13, cf. FIG. 1. It is understood that more than the two drawn flat side outlets could be provided.

The named flat side outlets 14 and 15 advantageously extend substantially over the total width of the flat side 8 of the chute 7. The flat side outlets 14 and 15 in this respect define an outlet direction 16 which is inclined at an acute angle to the falling direction through the chute 7. The flat side outlets 14 and 15 include an outlet channel 17 which sets the named output direction 16 and is bounded by an obliquely inclined, roof-shaped channel wall 18.

Shunts 19 and 20 are respectively arranged in the flat side outlets 14 and 15 which are substantially of plate shape and are advantageously formed in chamber-like manner with a plurality of slit-shaped recesses parallel to one another, as FIG. 1 shows. The shunts 19 and 20 in this respect each essentially have the shape of a rectangular plate whose edge facing into the chute 7 can be scarfed as FIG. 4 shows.

The shunts 19 and 20 are advantageously made as rockers and are pivotably supported at the housing body 2 around transverse axes 21 which extend transversely to the falling direction through the chute 7. The shunts 19 and 20 are arranged such that they are movable to and fro between a pass position and a channeling off position. In the pass position, in which the upper shunt 19 is shown in FIG. 4, the shunts 19 and 20 do not project into the chute 7 and/or the shunts 19 and 20 close the associated flat side outlet 14 and 15 so that coins falling through the chute 7 fall past the respective flat side outlet and fall over the next flat side outlet or finally the base outlet 13. In the channeling off position, in contrast, the shunts 19 or 20 project into the chute 7 and block it so that coins falling through the chute 7 are taken up by the shunt 19 and 20 and channeled off via the associated flat side outlet 14 and 15. In FIG. 4, the upper shunt 19 is shown in the channeling off position in which the shunt 19 extends substantially parallel to the roof 18 bounding the outlet channel 17. In the pass position, in which the lower shunt 20 is shown in FIG. 4, it can extend substantially parallel to the chute 7.

The two shunts 19 and 20 are advantageously actuated via a respective separate actuator 22 or 23 in the form of an electromagnet which is advantageously arranged on the flat side 9 of the chute 7 disposed opposite the flat side outlets 14 and 15. The setting members of the actuators 22 and 23 are in this respect connected in each case in the drawn embodiment via fork-shaped tension/compression rods 24 to the respective associated shunt 19 and 20 so that movements of the setting members of the actuators 22 and 23 can be converted into corresponding tilting movements of the shunts 19 and 20. The named tension/compression rods 24 are pivotally connected to the plate-shaped shunts 19 and 20.

Figure 4:
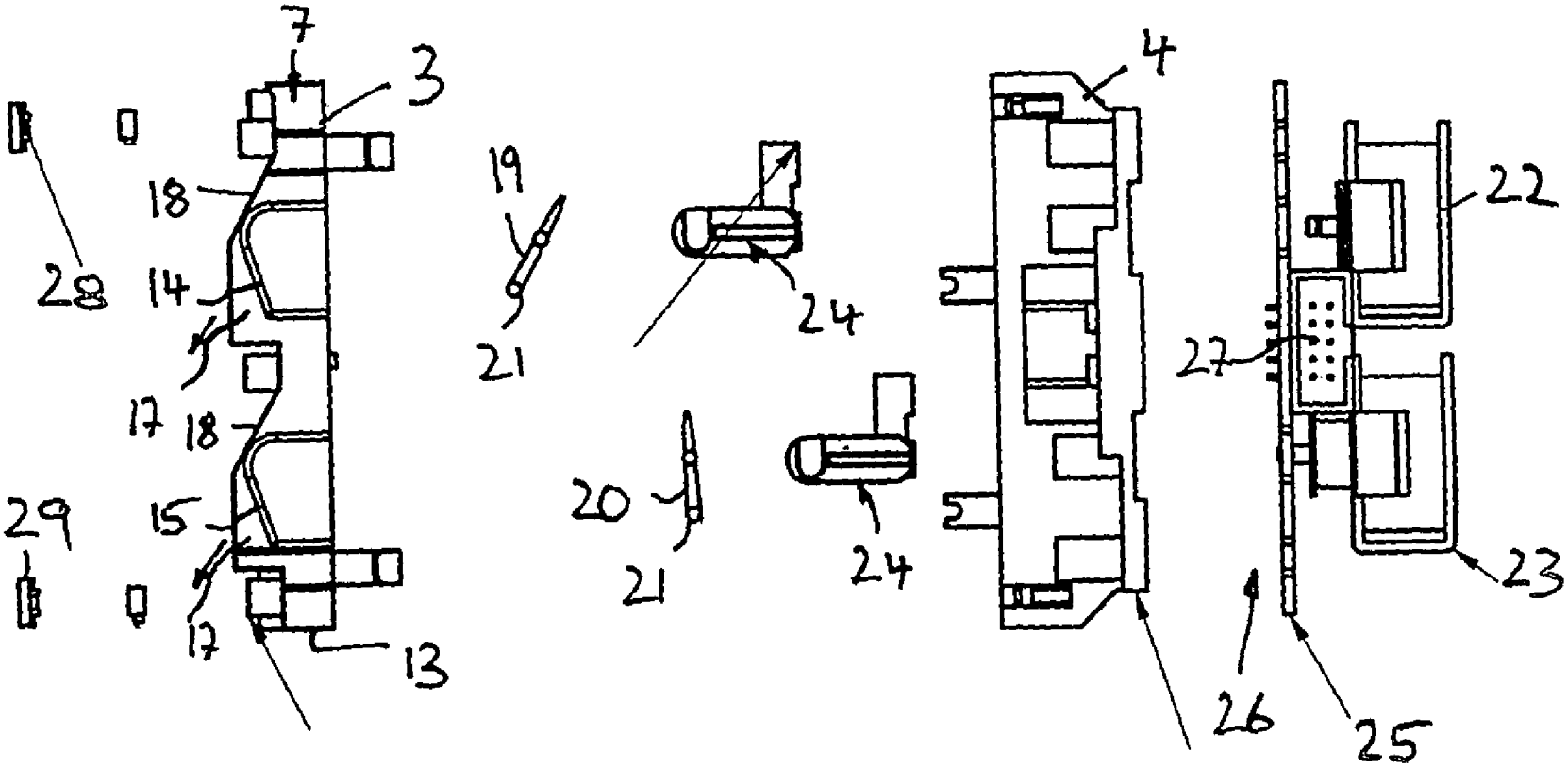
FIG. 4: an exploded representation of the sorter of the preceding Figures.

As FIG. 1 and FIG. 4 show, the actuators 22 and 23 are seated on a printed circuit board 25 of a control device 26 for the control of the shunts 19 and 20. The printed circuit board 25 is in this respect seated on the molded control part 4 directly on its wall which bounds the chute 7.

The control device 26 advantageously has a suitable communications interface 27 to ensure a fast signal processing. The control device 26 is in particular connected via the said interface 27 to a coin checker which is disposed before the sorting device 1 and which states which coins or tokens or chips are coming into the chute 1 so that the corresponding shunts 19 and 20 can be switched in dependence on a presettable sorting algorithm. The communications interface 27 can in this respect generally have various designs. In accordance with an advantageous embodiment of the invention, a parallel interface can be provided at the coin sorter via which the coin sorter is connected to the previously disposed coin checker which can in turn preferably have a USB interface to communicate with the CPU of the device. Different interface configurations are generally possible by means of which the data communication can be effected, thus for example also a serial interface which can be provided at the coin sorter alternatively or additionally to the named parallel interface. In an advantageous further development of the invention, the control device for the shunt control can have a USB interface.

Figure 2:
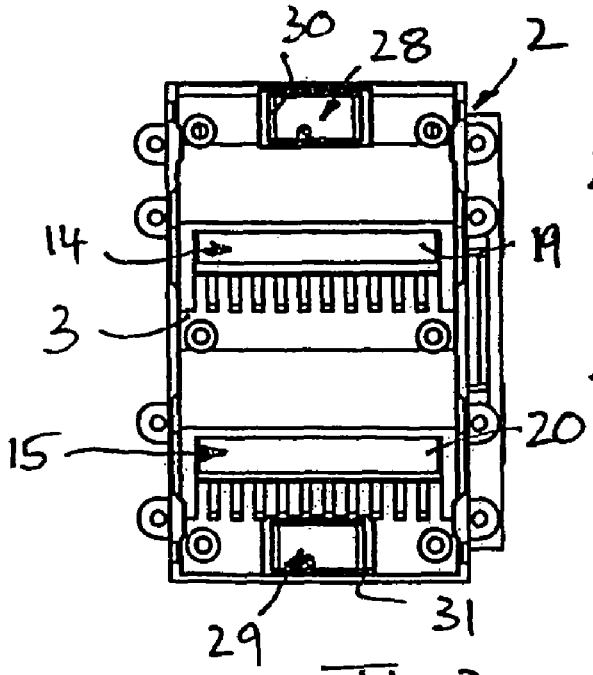
FIG. 2: a plan view of the side of the sorter of FIG. 1 having the flat side outlets.
Figure 3:
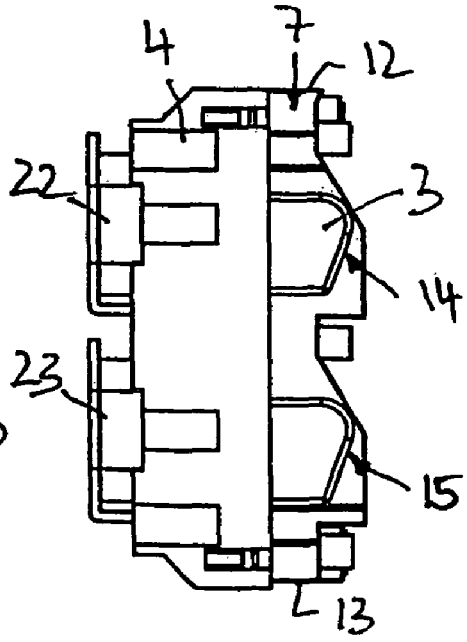
FIG. 3: a side view of the sorter of the preceding Figures.

Furthermore, the control device 26 is connected to passage monitoring means which monitor the passage of coins or tokens or chips through the chute 7 and its inlets and outlets. In the drawn embodiment, light barriers 28 and 29 are provided at the inlet 12 and at the base outlet 13. As FIG. 1 and FIG. 2 show, the housing part 3 includes sensor recesses 30 and 31 on the flat side 8 of the chute 7, approximately centrally with respect thereto. Suitable light barrier detectors can be introduced in the named sensor recesses 30 and 31.

The passage through the flat side outlets 14 and 15 is advantageously monitored via position sensors which detect the position of the shunts 19 and 20 and are not shown separately in the drawings. They can, for example, include contact sensors which detect the channeling off position of the shunts 19 and 20.

The following operation thus results: If a coin moves via the inlet 12 into the chute 7, this is reported to the control device 26 via the light barrier 28. Said control device has previously received a signal from the preceding coin checker which individualizes the corresponding coin such that the control device 26 can determine via which outlet the coin should be sorted. If, for example, the coin should be channeled off via the second flat side outlet 15, the control device 26 leaves the first shunt 19 in its pass position, while it controls the actuator 23 for the second shunt 20 to move the shunt 20 into its channeling off position. As soon as sufficient time has passed for the coin to have been channeled off via the named shunt 20 and the associated flat side outlet 15, the control device 26 resets the shunt. This can take place in a fraction of a second such that the coin sorter is directly available for the next coin again.

The invention claimed is:

1. A device for sorting coins, tokens, or chips comprising a housing (3, 4) having connection surfaces for the connection to a coin chute of a gambling machine, of its coin checker or of another coin processing device; a chute (7) leading through the housing (3, 4) and having at least one inlet (12) connectable to the coin chute and a plurality of outlets (13, 14, 15), wherein the chute (7) leading through the housing (3, 4) has minor and major sides defining a flat, substantially rectangular cross-section transverse to the falling direction, wherein the chute (7) has at least two flat side outlets (14, 15) which are arranged one above the other in the falling direction and which branch off the chute (7) at a first major side (8) of the chute and lead out of the housing (3, 4), the chute also having a base outlet (13) at the end of the chute in the falling direction, wherein respective shunts (19, 20) are associated with the flat side outlets (14, 15) and are movable between a channeling off position projecting into the chute (7) and a pass position, wherein a control device (26) is provided for the control of the shunts (19, 20) which has at least one external interface (27) for the exchange of control data for the shunts and a printed circuit board (25) which is seated on the housing side at a second major side of the chute disposed opposite the flat side outlets (14, 15) and has control components for the control of the shunts (19, 20) so that the chute (7) is seated sandwiched between the flat side outlets (14, 15) and the control device (26).

2. A device in accordance with claim 1, wherein respective passage monitoring means (28, 29) are associated with the inlet (12) of the chute (7) and with at least one of the two flat side outlets (14, 15), also with the base outlet (13) of the chute (7).

3. A device in accordance with claim 2, wherein a light barrier (28, 29) is associated with the inlet (12) and the base outlet (13) for the monitoring of the passage of a coin, of a chip or of a token.

4. A device in accordance with claim 2, wherein the passage monitoring means associated with the flat side outlets (14, 15) each include position detectors for the monitoring of the shunt position (19, 20).

5. A device in accordance with claim 1, wherein the shunts (19, 20) are actuable independently of one another and/or a separate actuator (22, 23) actuable via outside energy is associated with each shunt (18, 19) for the actuation of the respective shunt (19, 20).

6. A device in accordance with claim 5, wherein electromagnetic actuators (22, 23) are provided for the actuation of the shunts (19, 20).

7. A device in accordance with claim 5, wherein the respective actuator (22, 23) is coupled to the associated shunt (19, 20) by a tension and/or compression rod (24) which is pivotally connected to a setting member of the respective actuator (22, 23), on the one hand, and to the shunt (19, 20), on the other hand.

8. A device in accordance with claim 1, wherein the shunts (19, 20) are each made as pivotably supported rockers.

9. A device in accordance with claim 1, wherein an electronic control device (26) is provided for the control of the shunts (19, 20).

10. A device in accordance with claim 9, wherein the electronic control device (26) is connectable to a coin checker connected before the chute (7) and has control means for the control of the movement of the shunts (19, 20) in dependence on a signal of the coin checker.

11. A device in accordance with claim 9, wherein the electronic control device (26) is connectable to passage monitoring means (28) associated with the inlet (12) of the chute (7) and has control means for the control of the shunts (19, 20) in dependence on a signal of the passage monitoring means (28).

12. A device in accordance with claim 11, wherein the control means have a timer for the actuation of the respective shunt (19, 20) within a predetermined time window after output of the signal of the passage means.

13. A device in accordance with claim 11, wherein the control device has restoration means for the restoration of the shunts (19, 20) after each coin channeled off via the respective shunt.

14. A device in accordance with claim 1, wherein the shunts (19, 20) are actuable under compulsory control in both opposite directions of movement both in their channeling off position and in their pass position.

15. A device in accordance with claim 1, wherein the shunts (19, 20) can be set selectively by dual-action actuators (22, 23) in the channeling off position or in the pass position.

16. A device in accordance with claim 1, wherein the control device (26) has a communications interface (27) for data communication with further device components.

17. A device in accordance with claim 1, wherein the two flat side outlets (14, 15) each have an outlet channel (17) inclined at an acute angle to the falling direction of the chute (7).

18. A device in accordance with claim 17, wherein all the flat side outlets (14, 15) have the same inclination angle.

19. A device in accordance with claim 1, wherein the flat side outlets (14, 15) are arranged on the same flat side (8) of the chute (7).

20. A device in accordance with claim 1, wherein the flat side outlets (14, 15) are arranged above the base outlet (13) in the falling direction of the chute (7).

21. A device in accordance with claim 1, wherein a printed circuit board (25) having control components for the control of the shunts (19, 20) is arranged on a flat side (9) of the chute (7) disposed opposite the flat side outlets (14, 15) and is seated directly on a flat side wall of the chute (7).

22. A device in accordance with claim 1, wherein the chute (7) has a substantially vertical falling direction.

23. A device in accordance with claim 1, wherein the flat side outlets (14, 15) are arranged such that they lead into the interior of a device body of a gaming machine and/or of an entertainment device.

24. A device in accordance with claim 1, wherein the flat side outlets (14, 15) are connected to a respective pay-out store, and the base outlet (13) is connected to a cash store.

25. A device in accordance with claim 1, wherein three or more flat side outlets are arranged above one another on the same flat side (8) of the chute (7).

26. A gaming machine and/or entertainment device comprising an apparatus for sorting coins, tokens, or chips in accordance with claim 1.

* * * * *